United States Patent [19]

Kakiuchi et al.

[11] 4,399,334

[45] Aug. 16, 1983

[54] SPEAKER UNIT FOR HEADPHONES

[75] Inventors: Tsutomu Kakiuchi, Toda; Yoshiyuki Kamon, Yokohama, both of Japan

[73] Assignee: Sony Corporation, Tokyo, Japan

[21] Appl. No.: 252,442

[22] Filed: Apr. 9, 1981

[30] Foreign Application Priority Data

Apr. 17, 1980 [JP] Japan ..... 55-52135[U]

[51] Int. Cl.[3] ..... H04R 7/26

[52] U.S. Cl. ..... 179/180; 179/115.5 R; 181/157

[58] Field of Search .... 179/115.5 GS, 180, 115.5 PC, 179/115.5 VC, 115.5 R, 184, 182 R; 181/166, 157

[56] References Cited

U.S. PATENT DOCUMENTS

| | | | |
|---|---|---|---|
| 2,049,766 | 8/1936 | Glen | 181/157 |
| 3,867,586 | 2/1975 | Maekawa | 179/115.5 GS |
| 4,297,537 | 10/1981 | Babb | 179/180 |

FOREIGN PATENT DOCUMENTS

| | | | |
|---|---|---|---|
| 554098 | 6/1932 | Fed. Rep. of Germany | 179/180 |

*Primary Examiner*—G. Z. Rubinson
*Assistant Examiner*—L. C. Schroeder
*Attorney, Agent, or Firm*—Hill, Van Santen, Steadman & Simpson

[57] ABSTRACT

A speaker unit for headphones including a magnetic circuit which has a magnetic gap and including a diaphragm which is moveable to generate sound in response to energy applied to a coil wound on a bobbin which is connected to the diaphragm and mounted within the magnetic gap and including a frame for supporting the magnetic circuit and the diaphragm and a protecting means mounted at the front of the diaphragm and having projections so as to engage the diaphragm near the region where the bobbin is mounted so as to limit the maximum motion of the diaphragm and the protecting means formed with openings such that the protector prevents the bobbin from moving completely out of the magnetic gap. The invention is applicable to speaker units for open air type headphones, for example.

7 Claims, 3 Drawing Figures

SPEAKER UNIT FOR HEADPHONES

BACKGROUND OF THE INVENTION

1. Field of the Invention

This invention relates in general to a speaker unit particularly for use in a headphone set and comprises an open air headphone.

2. Description of the Prior Art

Generally, open air type headphones include an ear cup as a housing which is perforated and an ear pad which is formed of urethane or similar material which has air permeability so that sound which is generated and obtained from a diaphragm of the headphone unit will be radiated therethrough to the user. Such open air type headphones can be worn without tiring or causing excessive pressure against the ears.

In such open air type headphones, however, since the sound is radiated to the outside of the headphone housing, stronger sound pressure is required as compared to closed type of headphones. Therefore, the open air type headphone is constructed so that the amplitude of the diaphragm is larger than that in closed headphone types.

A result is that in the event there is a very high output level of an amplifier connected to the headphone which is applied either accidentally when a tone arm having a reproducing needle is dropped on to a recorded disc or under any conditions where an abnormal high level signal is fed to a voice coil of the speaker, the diaphragm will be very strongly vibrated and the bobbin which carries the voice coil and is attached to the diaphragm will have a large movement. At such times, the bobbin can be caught on the yoke or pole piece comprising the magnetic circuit of the speaker and cannot return to its predetermined rest position. This can result in rendering the headphone inoperative and unuseable. In the prior art, the compliance or linearity of the edge portion of the diaphragm is intentionally selected so that it is smaller than the remaining portion of the diaphragm so as to protect the diaphragm from protruding. However, a speaker constructed in this manner will have less dynamic range and bad sound characteristics which is undesirable.

SUMMARY OF THE INVENTION

It is an object of the present invention to provide an improved speaker unit for a headphone set of the open-air type.

Another object of the invention is to provide an improved speaker unit which is protected from faulty operations of an amplifier or a record player.

Yet another object of the invention is to provide an improved speaker unit with a wide dynamic range and desirable sound characteristics.

In the invention, an improved speaker unit comprises a magnetic circuit with a magnetic gap and a diaphragm and a bobbin which has wound about it a voice coil and is connected to the diaphragm with the bobbin and voice coil mounted in the magnetic gap and a frame for supporting the magnetic circuit and the edges of the diaphragm and including a protector mounted at the front of the diaphragm to prevent it from being over driven. The protector includes at least one or more projections engageable with the diaphragm and includes openings through which the sound can be admitted so as to prevent damage to the voice coil bobbin.

Other objects, features and advantages of the invention will be readily apparent from the following description of certain preferred embodiments thereof taken in conjunction with the accompanying drawings although variations and modifications may be affected without departing from the spirit and scope of the novel concepts of the disclosure and in which:

DESCRIPTION OF THE PREFERRED EMBODIMENTS

Figure 1:
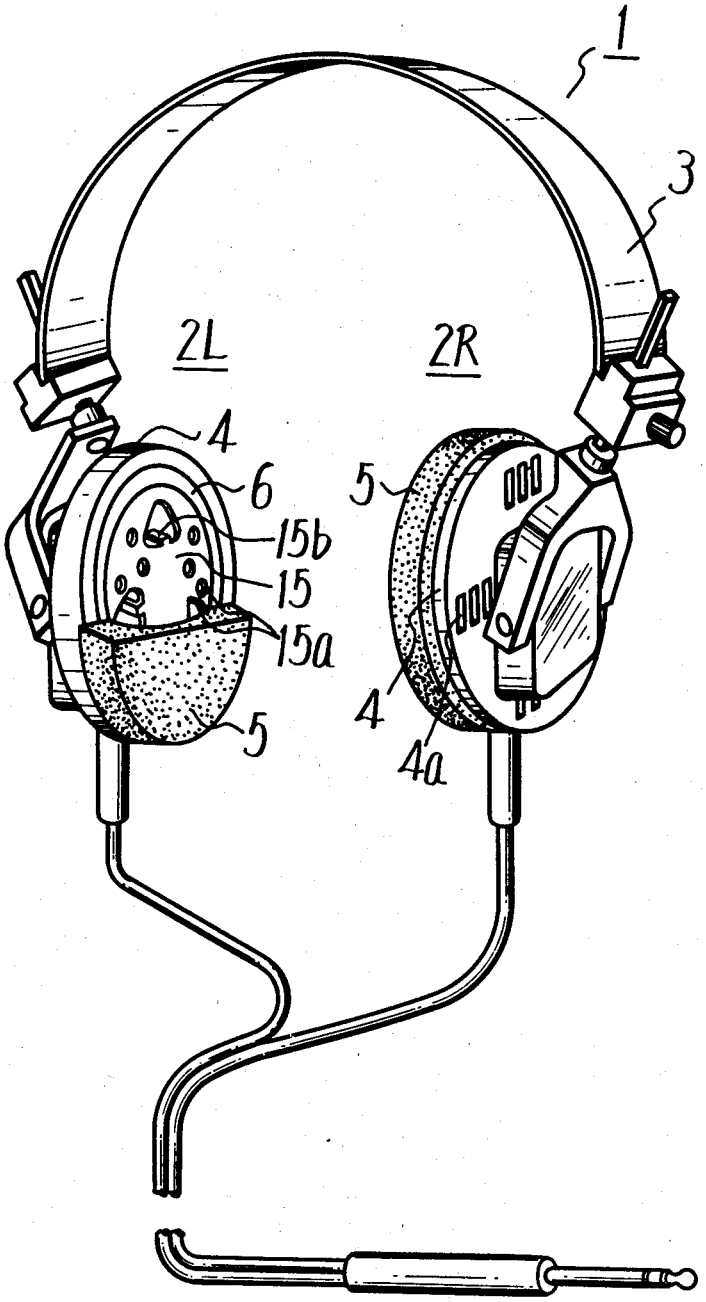
FIG. 1 is a perspective view of a headphone including one embodiment of a speaker unit according to the invention.
Figure 2:
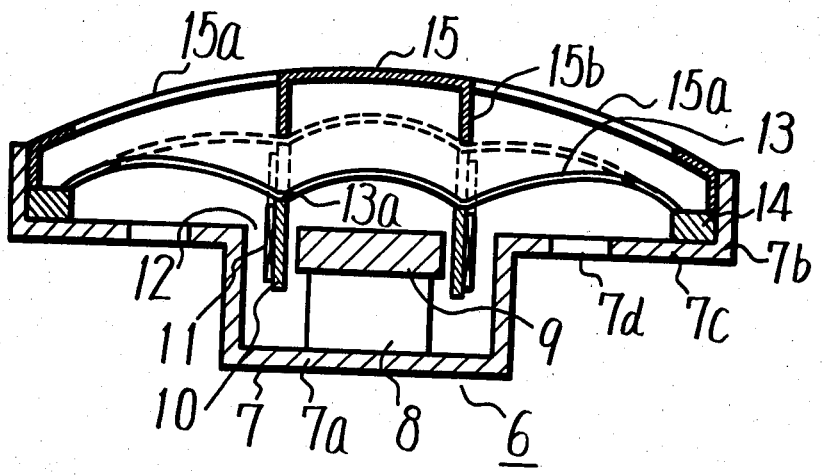
FIG. 2 is a sectional view illustrating one embodiment of the invention.

FIG. 1 illustrates a headphone 1 which has a left headphone unit 2L and a right headphone unti 2R connected by a headband 3. Each of the units 2L and 2R are constructed in the same manner and include as a housing an open ear cup 4 which is perforated with plural air vents 4*a* on the side away from the ear and has an ear pad 5 which is composed of air permeable material such as urethane and which is attached to the ear cup 4 on the side engageable with the ear. As shown in FIG. 2, the headphone unit 2 includes a speaker unit 6 which is mounted within the housing 4. The speaker unit 6 comprises a yoke 7 of the shape illustrated in FIG. 2 and comprises a hollow portion 7*a* in the center of the yoke and with a disc-shaped extending portion 7*c* which extends from the hollow portion 7*a* and is formed with openings 7*d* for controlling the back pressure of the speaker. The outer edge 7*b* of the yoke is ring-shaped as shown in FIG. 2. A permanent magnet 8 is attached to the center portion 7*a* and has a pole piece 9 attached to the upper portion of the magnet 8 as illustrated in FIG. 2.

A cylindrical shaped bobbin 10 carries a voice coil 11 which is wound about the bobbin and is attached to the back surface of a diaphragm 13. The connecting junction between the diaphragm 13 and the bobbin 10 is designated by 13*a* in FIG. 2. The outer edges of the diaphragm 13 are attached to the edge portions 7*b* of the yoke 7 with a diaphragm ring 14.

Figure 3:
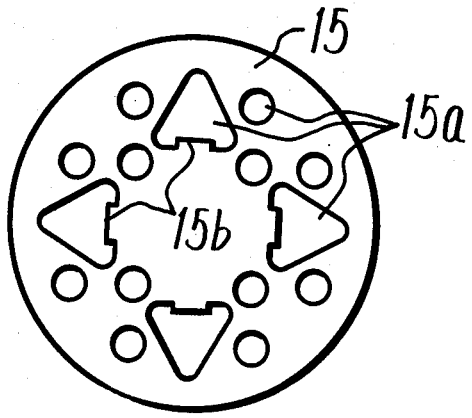
FIG. 3 is a front plan view of a protector utilized in one embodiment of the invention.

The structure of the speaker unit 6 thus described is similar to a conventional speaker unit and in the present invention, a protector 15 is mounted at the front of the diaphragm 13. The protector 15 can be made of a metal such as aluminum and has plural openings 15*a* as illustrated in FIGS. 2 and 3 at predetermined positions for ventilation. The protector unit 15 is connected to the outer portion 7*b* of the yoke 7 as illustrated in FIG. 2. Extending inwardly from the central portion of the protector unit 15 are a plurality of projections 15*b* which are capable of engaging the diaphragm 13 and limiting its upward motion relative to FIG. 2. The projections 15*b* of which there are four illustrated in FIG. 3 although the invention is not limited to a specific number of projections, are located such that they engage the diaphragm 13 in alignment with the bobbin 10 as can be clearly seen in FIG. 2.

The projections 15*b* have a length so that they are designed not to engage the diaphragm 13 under normal operation of the speaker and even when the diaphragm 13 is driven at the maximum range at which a normal audio signal is fed to the voice coil 11. Thus, in normal operation, the speaker operates without engagement between the protector extensions 15*b* and the diaphragm 13.

However, when an abrupt high level signal which is greater than normally applied to the speaker is fed to the voice coil 11 which causes the diaphragm 13 to move an extreme amount as illustrated in FIG. 2 by a broken line, the connecting portion 13*a* of the diaphragm and the bobbin 10 will engage the projection 15*b* such that relative to FIG. 2 the lowest portion of the bobbin 10 will not rise above the top surface of the pole piece 9 or the upper plane surface of the portion 7*c* of the yoke 7.

Thus, the projection 15*b* act as a protector for the diaphragm 13 in that it limits the upward motion of the bobbin 10 to the broken line position illustrated in FIG. 2 so that the speaker will not be overdriven or be injured by such abrupt high level signal changes which are fed to the voice coil.

Also, the protector 15 serves as an equilizer and it is formed with a plurality of openings 15*a* generally formed in the outer portions of the protector 15 as illustrated in FIG. 3 rather than at the center of the protector.

The arrangement of the openings is such that the vibrations of the diaphragm 13 is controlled so that the frequency characteristics are smooth or flat which has been observed in experiments in which apparatus according to the invention have been constructed and tested.

In addition, of course, the protector 15 protects the diaphragm 13 from being injured by contact by an obstacle outside of the speaker unit.

Thus, it is seen that in the invention, the protector cover unit 15 protects the diaphragm 13 and under normal operations the projections 15*b* do not engage the diaphragm. However, during extreme loads which are higher than normal and which indicate a condition which would overload the diaphragm 13 the projections 15*b* engage the diaphragm and hold the bobbin 10 to the limiting position as illustrated in dashed line in FIG. 2.

Although the invention has been described with respect to preferred embodiments, it is not to be so limited as changes and modifications can be made which are within the full intended scope of the invention as defined by the appended claims.

We claim as our invention:

1. A speaker unit comprising, a frame, a magnetic circuit having a magnetic gap mounted in said frame, a diaphragm with its outer edge mounted to said frame, a bobbin wound with a voice coil connected to said diaphragm and disposed within said magnetic gap, and protecting means attached to said frame and disposed at the front of said diaphragm, said protecting means having at least one opening and one projection on the side of said diaphragm, and said protecting means engageable with said diaphragm only when said diaphragm is overdriven, wherein said projection is aligned with the edge of said bobbin so as to limit the movement of said voice coil, said bobbin and said diaphragm.

2. A speaker unit according to claim 1, wherein said opening is provided in the outer area of said protecting means.

3. A speaker unit according to claim 1, wherein said projection is positioned at the edge of said opening of said protecting means.

4. A speaker unit comprising a cylindrical frame member, a diaphragm with its outer edges attached to said frame member, a cylindrical shaped bobbin of thickness "T" attached to the rear side of said diaphragm and a voice coil mounted thereon, a magnetic circuit with pole pieces attached to said frame adjacent said bobbin and magnetically coupled to said voice coil, a front protective cover attached to said frame and having at least one inwardly extending projection which extends toward said diaphragm and engageable therewith when said diaphragm is over driven, wherein said one inwardly extending projection is aligned with an edge of said cylindrical shaped bobbin so as to limit the movement of said bobbin, said voice coil and said diaphragm.

5. A speaker unit according to claim 4 wherein said frame has openings formed in the portion at the rear of the diaphragm and said front protective cover has openings formed therein.

6. A speaker unit according to claim 4 wherein a plurality of inwardly extending projections aligned with the edge of said bobbin.

7. A speaker unit according to claim 6 wherein the lengths of said extending projections is such that the outward movement of said bobbin is limited to not more than the thickness "T" of said bobbin.

* * * * *